US011448457B2

(12) United States Patent
Scalf et al.

(10) Patent No.: US 11,448,457 B2
(45) Date of Patent: Sep. 20, 2022

(54) REFRIGERATOR WITH AN ADJUSTABLE BIN

(71) Applicant: Midea Group Co., Ltd., Foshan (CN)

(72) Inventors: Eric Scalf, Louisville, KY (US); Vinayak Naik, Louisville, KY (US)

(73) Assignee: MIDEA GROUP CO., LTD., Foshan (CN)

( * ) Notice: Subject to any disclaimer, the term of this patent is extended or adjusted under 35 U.S.C. 154(b) by 0 days.

(21) Appl. No.: 17/489,591

(22) Filed: Sep. 29, 2021

(65) Prior Publication Data

US 2022/0018593 A1 Jan. 20, 2022

Related U.S. Application Data

(63) Continuation-in-part of application No. 17/215,854, filed on Mar. 29, 2021, now Pat. No. 11,313,616, which is a continuation of application No. 16/720,893, filed on Dec. 19, 2019, now Pat. No. 10,962,279.

(51) Int. Cl.

| | |
|---|---|
| ***F25D 25/00*** | (2006.01) |
| ***F25D 23/02*** | (2006.01) |
| ***A47B 96/16*** | (2006.01) |

(52) U.S. Cl.

CPC ..... *F25D 25/005* (2013.01); *F25D 23/028* (2013.01); *A47B 96/16* (2013.01); *F25D 2323/02* (2013.01); *F25D 2325/021* (2013.01)

(58) Field of Classification Search

CPC .. F25D 25/005; F25D 23/028; F25D 2323/02; F25D 2325/021; A47B 96/16

See application file for complete search history.

(56) References Cited

U.S. PATENT DOCUMENTS

| | | | | |
|---|---|---|---|---|
| 2,741,370 | A | 4/1956 | Dills | |
| 4,124,262 | A | 11/1978 | Schill | |
| 7,748,805 | B2 * | 7/2010 | Lucas | F25D 23/067 312/405.1 |
| 8,083,303 | B2 | 12/2011 | Compagnucci | |

(Continued)

FOREIGN PATENT DOCUMENTS

| | | | |
|---|---|---|---|
| EP | 3104106 | A1 | 12/2016 |
| KR | 20080027648 | A | 3/2008 |

(Continued)

OTHER PUBLICATIONS

U.S. Patent and Trademark Office,Notice of Allowance issued in U.S. Appl. No. 17/215,854 dated Mar. 17, 2022.

(Continued)

*Primary Examiner* — Daniel J Rohrhoff

(74) *Attorney, Agent, or Firm* — Middleton Reutlinger

(57) ABSTRACT

A refrigerator appliance having one or more adjustable bins. The refrigerator door may include the one or more adjustable bins. The adjustable bin may move along one or more rails. The adjustable bin may include one or more actuators engaging the one or more rails. The adjustable bin may include one or more bushings slidably engaging the one or more rails. The adjustable bin may include a storage bin removable from a carriage. The adjustable bin may include a locking mechanism between the storage bin and the carriage. The carriage may include one or more actuators.

21 Claims, 13 Drawing Sheets

(56) References Cited

U.S. PATENT DOCUMENTS

| | | | | |
|---|---|---|---|---|
| 8,322,804 | B2 | 12/2012 | Kim | |
| 9,103,581 | B2 * | 8/2015 | Babinski | F25D 23/04 |
| 9,347,703 | B2 | 5/2016 | Kwon et al. | |
| 9,518,776 | B2 * | 12/2016 | Baldo | F25D 25/02 |
| 9,593,878 | B2 | 3/2017 | Celik et al. | |
| 9,644,884 | B2 * | 5/2017 | Kong | F25D 23/04 |
| 9,657,984 | B2 * | 5/2017 | Wang | F25D 23/067 |
| 9,861,199 | B2 | 1/2018 | Ferreira et al. | |
| 10,330,371 | B2 | 6/2019 | Jung | |
| 10,578,350 | B2 | 3/2020 | Yao et al. | |
| 10,694,843 | B2 * | 6/2020 | Nuss | A47B 57/06 |
| 10,729,238 | B2 * | 8/2020 | Xiang | A47F 5/0081 |
| 10,962,279 | B1 | 3/2021 | Scalf et al. | |
| 2005/0200251 | A1 | 9/2005 | Stone, III | |
| 2010/0175414 | A1 * | 7/2010 | Kim | F25D 23/04 62/449 |
| 2010/0176702 | A1 | 7/2010 | Kim | |
| 2012/0293056 | A1 | 11/2012 | Kim | |
| 2013/0081421 | A1 | 4/2013 | Kwon et al. | |
| 2014/0062283 | A1 | 3/2014 | Baldo | |
| 2015/0330700 | A1 * | 11/2015 | Celik | F25D 25/02 312/405.1 |
| 2017/0184335 | A1 | 6/2017 | Jeon et al. | |
| 2019/0078837 | A1 * | 3/2019 | Bento | F25D 23/067 |
| 2021/0088270 | A1 * | 3/2021 | Allgeier | F25D 25/02 |
| 2021/0180855 | A1 * | 6/2021 | Wang | F25D 25/04 |
| 2021/0215416 | A1 | 7/2021 | Scalf et al. | |

FOREIGN PATENT DOCUMENTS

| | | | | |
|---|---|---|---|---|
| KR | 20150142221 | A | 12/2015 | |
| WO | WO-2011093577 | A1 * | 8/2011 | A47B 96/16 |
| WO | WO2014083463 | A1 | 6/2014 | |
| WO | WO2014166868 | A1 | 10/2014 | |
| WO | WO-2018114195 | A1 * | 6/2018 | F25D 23/04 |
| WO | WO2019042921 | A1 | 3/2019 | |
| WO | WO2020181928 | A1 | 9/2020 | |

OTHER PUBLICATIONS

U.S. Patent and Trademark Office, Office Action issued in U.S. Appl. No. 17/215,854 dated Nov. 23, 2021.

Youtube.com, Hettich | Comfortspin, WiQQI, Retrieved from: https://www.youtube.com/watch?v=xweGJ0_Mh38, Nov. 7, 2018.

U.S. Patent and Trademark Office, Office Action issued in U.S. Appl. No. 16/720,893 dated Oct. 20, 2020.

U.S. Patent and Trademark Office, Notice of Allowance issued in U.S. Appl. No. 16/720,893 dated Feb. 4, 2021.

* cited by examiner

REFRIGERATOR WITH AN ADJUSTABLE BIN

BACKGROUND

The present embodiments relate to an adjustable bin integrated into a refrigerator appliance.

Users often use an adjustable bin within a refrigerator appliance between predetermined locations dependent on fixed structure, such as molded-in hangers. However, this practice may limit the configurability of the bins/shelves within the refrigerator to accommodate user preferences or the variety of characteristics of the stored goods to be housed therein. Additionally, predetermined shelves do not maximize the space within the door area of the refrigerator. Thus, there is a need to allow flexible positioning of one or more bins/shelves within a refrigerator.

SUMMARY

In some embodiments of the invention, for example, a refrigerator appliance may include a housing defining at least one compartment. In various embodiments, the appliance may include at least one door attached to the housing. In addition, in some embodiments, at least one door may include at least one rail disposed about at least one door. In various embodiments, at least one adjustable bin may be moveable along at least one rail between at least one first location and at least one second location, wherein at least one first location may be different from at least one second location. Moreover, in some embodiments, at least one adjustable bin may include at least one through opening slidably receiving at least one rail. In various embodiments, at least one adjustable bin may include at least one actuator positionable between an engaged position securing at least one adjustable bin to at least one rail in at least one first location and a disengaged position allowing at least one adjustable bin to move between at least one first location and at least one second location. Moreover, in some embodiments, at least one adjustable bin may include at least one bushing positioned within at least one through opening positioning at least one adjustable bin from at least one rail.

In some embodiments, at least one bushing may include an upper bushing and a lower bushing. In various embodiments, the upper bushing may be adjacent a top end of at least one through opening and the lower bushing may be adjacent a bottom end of at least one through opening. In some embodiments, at least one adjustable bin may include an outer periphery, wherein the outer periphery may include a lateral receptacle intersecting at least one through opening, and wherein at least one actuator may be positioned in the lateral receptacle. In addition, in some embodiments, at least one adjustable bin may include a biasing member urging at least one actuator towards the engaged position. In various embodiments, at least one rail may extend from a top end of at least one door to a bottom end of at least one door. Moreover, in various embodiments, at least one adjustable bin may include at least one storage bin removable from a carriage. In some embodiments, the carriage may include at least one through opening. In various embodiments, at least one rail may be elongated in cross section transverse to a longitudinal direction of at least one rail.

In various embodiments, an adjustable bin for a door of a refrigerator appliance may include a body having a top side and an opposing bottom side interconnected by a pair of lateral sides. In some embodiments, the adjustable bin may include one or more through openings extending from the bottom side to the top side. Moreover, in various embodiments, the adjustable bin may include one or more actuators positioned adjacent to one or more through openings. In some embodiments, the adjustable bin may include a rail slidably engaging one or more through openings of the body. In various embodiments, the adjustable bin may include one or more actuators. In addition, in some embodiments, one or more actuators may be positioned within a receptacle in at least one lateral side of the pair of lateral sides and may be accessible by a user to releasably engage and/or disengage from the rail to adjust the body relative to the length of the rail.

In addition, in some embodiments, the body may include one or more bushings contacting the rail. In various embodiments, one or more bushings may include an upper bushing adjacent a top end of one or more through openings and a lower bushing adjacent a bottom end of one or more through openings. In some embodiments, the body may include one or more storage bins removable from a carriage. In various embodiments, one or more actuators may be a member having a fixed end attached to the body and a pivoting end, wherein the member may be pivoted about the fixed end between an engaged position with the rail and a disengaged position with the rail. In some embodiments, the adjustable bin may include a biasing member urging one or more actuators into engagement with the rail. Moreover, in various embodiments, one or more actuators may engage the rail between the top side and the bottom side of the body.

In various embodiments, a refrigerator appliance may include a housing defining at least one compartment. In some embodiments, the appliance may include at least one door attached to the housing, wherein at least one door may include at least one adjustable bin moveable along one or more rails between at least one first location and at least one second location, wherein at least one first location is different from at least one second location. In addition, in some embodiments, at least one adjustable bin may include a body having a top side and an opposing bottom side interconnected by a pair of lateral sides. In various embodiments, the adjustable bin may include one or more through openings extending from the bottom side to the top side. In some embodiments, one or more through openings may slidably engage one or more rails. Moreover, in various embodiments, the adjustable bin may include one or more actuators positioned adjacent to one or more through openings. In some embodiments, one or more actuators may be positioned within a receptacle in at least one lateral side of the pair of lateral sides and may be accessible by a user to releasably engage and/or disengage from one or more rails to adjust the body along a length of one or more rails.

In addition, in some embodiments, the body may include one or more bushings positioned within one or more through openings and contacting one or more rails. In various embodiments, one or more bushings may include an upper bushing and a lower bushing. In some embodiments, one or more actuators may be positioned between the upper bushing and the lower bushing. In various embodiments, one or more actuators may be a member having a fixed end attached to the body and a pivoting end, wherein the member may be pivoted about the fixed end between an engaged position with one or more rails and a disengaged position with one or more rails. In addition, in some embodiments, one or more rails may be a single rail adjacent each one of the lateral sides of the pair of lateral sides. Moreover, in various embodiments, each one of the single rails may be positioned adjacent a back side of the body.

In some embodiments, a refrigerator appliance may include a first rail. In various embodiments, the appliance may include a first carriage moveable along the first rail between at least one first location and at least one second location, wherein at least one first location is different from at least one second location. In some embodiments, the appliance may include a storage bin. In various embodiments, the appliance may include a locking mechanism releasably engaging the storage bin with the first carriage. Moreover, in some embodiments, the first carriage may include at least one through opening having an outer periphery defined by the first carriage. In various embodiments, at least one through opening may slidably receive the first rail. In some embodiments, the first carriage may include at least one first actuator positionable between an engaged position securing the first carriage to the first rail in at least one first location and a disengaged position allowing the first carriage to move between at least one first location and at least one second location.

In addition, in some embodiments, the locking mechanism may include a second actuator to releasably engage and/or disengage the storage bin from the first carriage. In various embodiments, the appliance may include a biasing member urging the second actuator into engagement with the storage bin. In some embodiments, the first carriage may include the second actuator, and the second actuator may slide to releasably engage and/or disengage the storage bin from the first carriage. In some embodiments, the appliance may include a tongue and groove engagement between the storage bin and the first carriage. In various embodiments, the appliance may include a stop mechanism, wherein the stop mechanism may limit relative movement between the storage bin and the first carriage along the tongue and groove engagement between the storage bin and the first carriage. In some embodiments, the appliance may include a second carriage movable along a second rail, wherein the storage bin may releasably engage both the first carriage and the second carriage.

In various embodiments, a refrigerator appliance may include at least one first rail. In some embodiments, the appliance may include at least one first carriage moveable along at least one first rail between at least one first location and at least one second location, wherein at least one first location is different from at least one second location. In various embodiments, the appliance may include at least one storage bin. In some embodiments, at least one first carriage may include at least one through opening having an outer periphery defined by at least one first carriage, and wherein at least one through opening may slidably receive at least one first rail. In some embodiments, at least one first carriage may include at least one first actuator positionable between an engaged position securing at least one storage bin to at least one first carriage in a fixed position and a disengaged position allowing at least one storage bin to move to an unfixed position different from the fixed position. In various embodiments, at least one first carriage may include at least one second actuator positionable between an engaged position securing at least one first carriage to at least one first rail in at least one first location and a disengaged position allowing at least one first carriage to move between at least one first location and at least one second location.

In addition, in some embodiments, the appliance may include at least one bushing, wherein at least one bushing may be positioned within at least one through opening positioning at least one first carriage from contact with at least one rail, wherein at least one bushing may be fixed to the outer periphery defining at least one through opening and slidably contacting at least one first rail. In various embodiments, the appliance may include a tongue and groove engagement between at least one storage bin and at least one first carriage. In some embodiments, the appliance may include a stop mechanism limiting travel of at least one storage bin along the tongue and groove engagement. Moreover, in some embodiments, the stop mechanism may be a member projecting from at least one storage bin to prevent downward travel of at least one storage bin relative to at least one first carriage when the tongue and groove engagement is engaged therebetween. In some embodiments, at least one first actuator may be a bias sliding member sliding to releasably engage and/or disengage a slot of at least one storage bin. In various embodiments, the appliance may include at least one second carriage movable along at least one second rail, wherein at least one storage bin releasably engages both at least one first carriage and at least one second carriage.

In various embodiments, a refrigerator appliance may include one or more rails. In some embodiments, the appliance may include one or more carriages moveable along one or more rails between at least one first location and at least one second location, wherein at least one first location is different from at least one second location. In various embodiments, the appliance may include one or more storage bins releasably engaging one or more carriages. In some embodiments, the appliance may include one or more actuators positionable between an engaged position securing one or more storage bins to one or more carriages in a fixed position and a disengaged position allowing one or more storage bins to move to an unfixed position different from the fixed position.

In addition, in some embodiments, one or more actuators may be positionable between an engaged position securing one or more carriages to one or more rails in at least one first location and a disengaged position allowing one or more carriages to move between at least one first location and at least one second location. In various embodiments, one or more carriages may include at least one through opening having an outer periphery defined by one or more carriages, and wherein at least one through opening slidably receiving one or more rails. Moreover, in some embodiments, at least one bushing may be positioned within at least one through opening positioning one or more carriages from contact with one or more rails, wherein at least one bushing may be fixed to the outer periphery defining at least one through opening and slidably contacting one or more rails. In various embodiments, one or more carriages may include at least one first carriage and at least one second carriage moving independently of at least one first carriage. In some embodiments, one or more storage bins may releasably engage both at least one first carriage and at least one second carriage with a tongue and groove engagement. In various embodiments, one or more carriages may include one or more actuators. In some embodiments, one or more actuators may slide between the engaged position and the disengaged position.

These and other advantages and features, which characterize the embodiments, are set forth in the claims annexed hereto and form a further part hereof. However, for a better understanding of the embodiments, and of the advantages and objectives attained through its use, reference should be made to the Figures and to the accompanying descriptive matter, in which there is described example embodiments. This summary is merely provided to introduce a selection of concepts that are further described below in the detailed description, and is not intended to identify key or essential features of the claimed subject matter, nor is it intended to be used in limiting the scope of the claimed subject matter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described techniques and apparatuses within a residential refrigerator appliance such as refrigerator appliance 10, such as the type that may be used in single-family or multi-family dwellings, or in other similar applications. However, it will be appreciated that the herein-described techniques and apparatuses may also be used in connection with other types of refrigerator appliances in some embodiments. For example, the herein-described techniques may be used in commercial applications in some embodiments. Moreover, the herein-described techniques may be used in connection with various refrigerator appliance configurations. Implementation of the herein-described techniques within side-by-side refrigerators, bottom freezer refrigerators, top freezer refrigerators, wine refrigerators and beverage centers, compact refrigerators, etc. would be well within the abilities of one of ordinary skill in the art having the benefit of the instant disclosure, so the embodiments are not limited to a french door refrigerator implementation discussed further herein.

Figure 1:
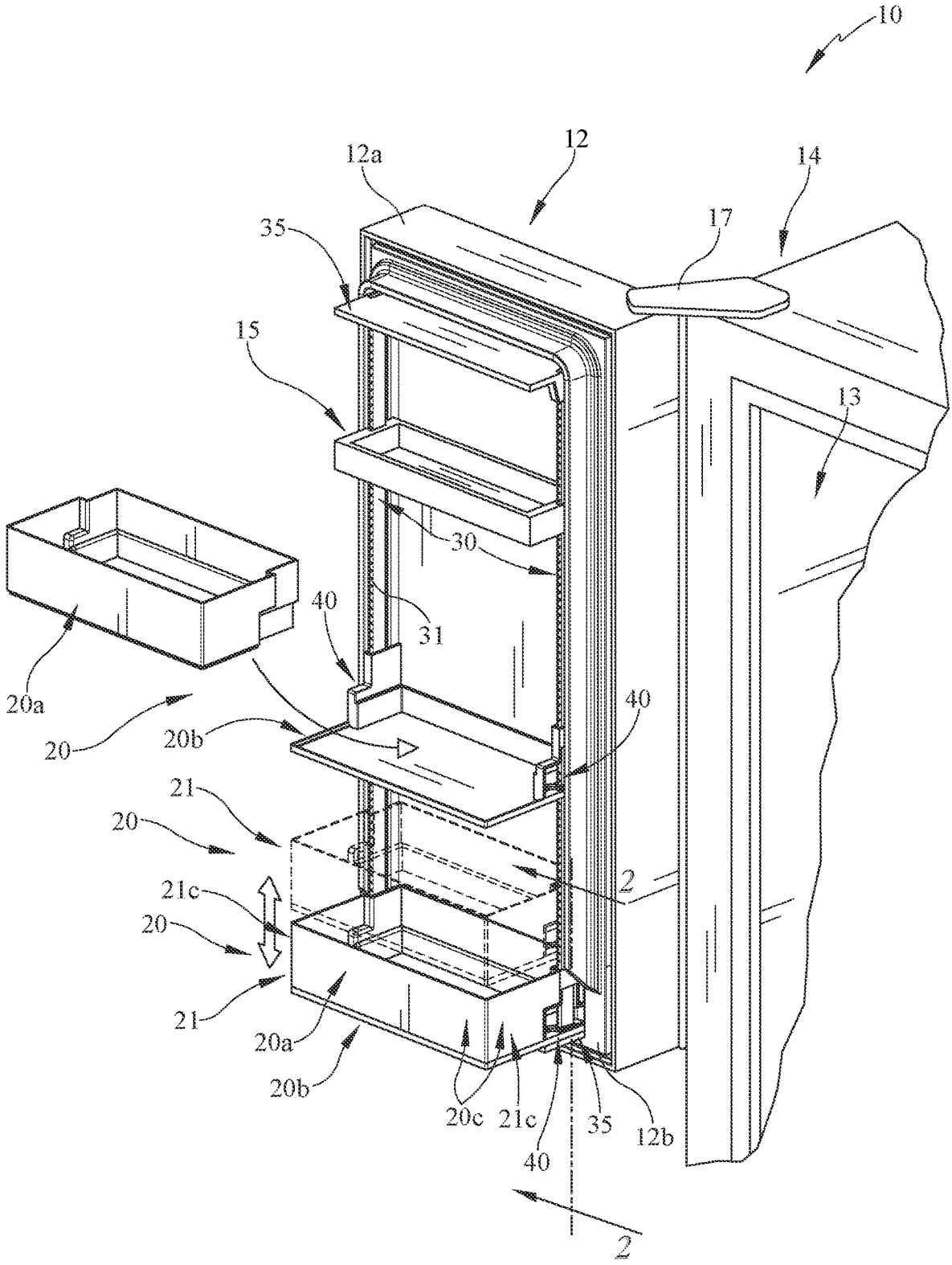
FIG. 1 is a perspective view of one embodiment of a refrigerator utilizing one or more adjustable bins within at least one door, with portions of the refrigerator broken away illustrating a removable storage bin separated from a carriage as well as one adjustable bin in broken lines moved to another position.
Figure 2:
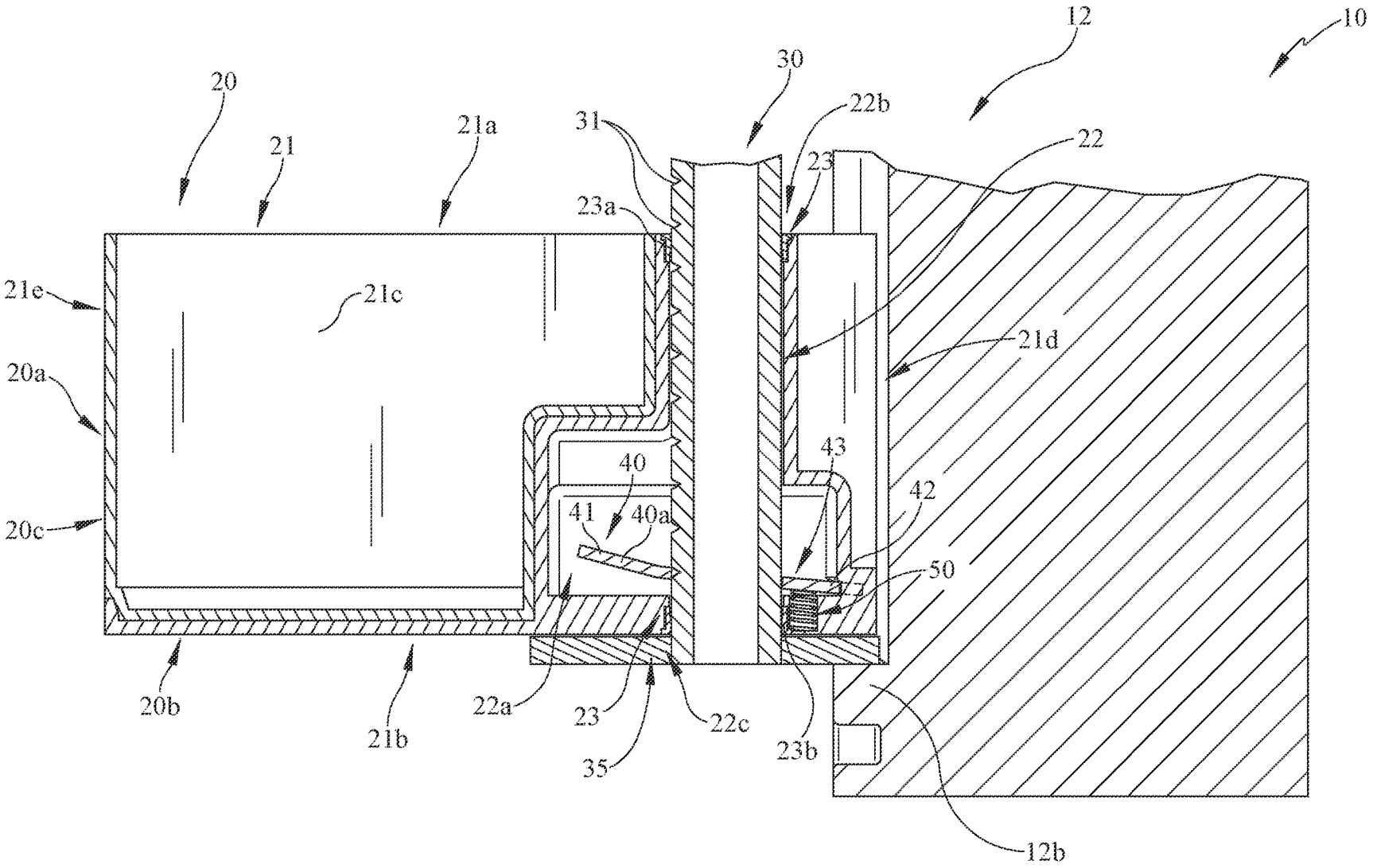
FIG. 2 is a sectional view of the embodiment of the adjustable bin of FIG. 1 taken along line 2-2 in an engaged configuration, illustrating an actuator in an engaged position with a rail and portions of the refrigerator door broken away.

Turning now to the Figures, FIG. 1 illustrates an example refrigerator appliance 10 in which the various technologies and techniques described herein may be implemented. Although, the adjustable bins 20 may used in a variety of appliances other than refrigerators 10 (e.g. ovens, dish washing machines, freezers, etc.). Refrigerator appliance 10 is depicted in this example as a french door refrigerator, and as such includes front-mounted doors 12 in a cabinet or housing 14 that provides access to the freezer and/or fresh-food compartment 13 housed within the cabinet or housing 14. The housing 14 and/or door 12 may at least partially define the one or more compartments. Similarly an adjacent pivotable door (not shown) may provide access to the one or more compartments (not shown) or portions thereof and when in the open position, food and beverage items may be inserted into and removed from the compartments. One or more doors 12 may be generally provided with a hinge 17 along a side or top edge of the housing 14 and/or compartment and is pivotable between an open position illustrated in FIG. 1 and a closed position (not shown). When door 12 is in the open position, food and beverage items may be inserted into and removed from the compartment 13 and/or bin 20 through the door 12 or, alternatively, through an opening in the door 12. Moreover, the adjustable bins 20 or portions thereof may be moved or travel between desired positions and/or removed (e.g. vertical). Control over refrigerator appliance 10 by a user is generally managed through a control panel, which can be disposed on the door. It will be appreciated that in different appliance designs (e.g. refrigerator), the adjustable bins/shelves 20 may be of a variety of shapes, sizes, quantities, positions within the appliance, and constructions and still be within the scope of the invention. For example, although the one embodiment of the adjustable bin 20 is positioned in the door, it should be understood that the one or more adjustable bins may be used in a variety of compartments or positions within an appliance. For example, the adjustable bin may be used in the other places besides the doors of an appliance for example within the fresh-food compartment and/or freezer compartment, etc. Moreover, the adjustable bin 20 may be used along with one or more fixed bins/shelves 15, if used.

As shown in the one embodiment in the Figures, a refrigerator appliance 10 may include one or more adjustable bins 20. Referring to FIGS. 1-4, the one or more adjustable bins 20 may be positioned and/or reconfigured within the door 12 of the refrigerator to create a variety of spacing and/or patterns to maximize the available space. The adjustable bin 20 (e.g. shelf, bin, one or more storage compartments, supports, hangers, wire frame, etc.) or portions thereof may move/travel between a plurality of positions along one or more rails 30 in one or more directions (e.g. vertical, horizontal, and/or angled, etc.) for a variety of distances. The one or more adjustable bins 20 may slidably engage and may be moveable along the rails 30 between positions (e.g. vertical positions, different elevations, different locations, etc.). As shown in the one embodiment, the one or more adjustable bins 20 may be moved/slid vertically along the one or more rails 30. The bin 20 may be selectively adjusted up and/or down with one or more actuators 40 and releasably fixed in one or more positions. The one or more actuators 40 may releasably engage and/or disengage from the one or more rails 30 allowing the relative movement of the adjustable bin 20 along the length or portions thereof of the rail 30. The rail 30 may include one or more notches 31, if used, along the length or portions thereof to provide positive stops or receive the one or more actuators 40 at a predetermined elevation/location defined by the one or more notches. The adjustable bin 20 may be a single or one-piece component (e.g. single molded piece), or as shown in the figures as multiple components combined. For example, the adjustable bin 20 may include removable portions or storage bins 20*a* separable from the remaining portion of a carriage 20*b* attached to the one or more rails 30. For example, the removable portions/storage bins 20*a* may be removed (e.g. upwardly and away from the door 12/rails 30) for cleaning. Moreover, the remaining portions or carriage 20*b* may allow for different storage characteristics or goods different from when the removable bin/portion 20*a* are combined and/or allow movement to maximize the available space. The removable storage bin 20*a* and/or carriage 20*b* may narrow in the direction towards the rail 30. The narrowing or decreasing width of the storage bin 20*a* may allow the storage bin 20*a* to pass between the rails/carriage or portions thereof. It should be understood that one or more portions of the adjustable bin 20 and/or rails 30 (e.g. storage bin 20*a*, carriage 20*b*, and/or portions thereof) may be removed from the rails/door if desired. The adjustable bin 20 and/or rails 30 may be used with one or more fixed bins 15 in some applications.

In some implementations, the adjustable bin 20 or portions thereof may include a body 21 (e.g. storage bins and/or carriage, etc.). The body 21 may include a top side 21*a* and an opposing bottom side 21*b*. A pair of lateral sides or walls 21*c* may interconnect the top and bottom sides 21*a*, 21*b*. As shown in the one embodiment, the body 21 may include one or more removable storage bins/portions 20*a* removeable from the carriage or base 20*b*. The body 21, carriage 20*b*, or other portions of the adjustable bin 20 may include one or more through openings 22. The bin 20, carriage 20*b*, body 21, and/or one or more through openings 22 may slidably receive or engage the one or more rails 30. The through opening 22 may extend from the top side 21*a* to the bottom side 21*b* of the body 21. The through opening 22 and/or one or more rails 30 may be located adjacent a back side 21*d* of the body 21 and/or carriage 20*b*, opposite from a front side 21*e*. The lateral sides 21*c* may include the one or more actuators 40 in some embodiments as shown. Each one of the lateral sides 21*c* may include the actuator 40, respectively. The actuators 40 may be accessible to the user on an outer periphery 20*c* of the adjustable bin 20 and/or outside of the lateral sides 21*c*. Alternatively, in some embodiments, the one or more actuators may be positioned and/or accessible on the inner periphery of the bin or portions thereof, top side, bottom side, front side, back side, etc. One or more lateral receptacles 22*a* within the lateral side 21*c* may position or receive the one or more actuators 40. The receptacle 22*a* may be defined by the body 21 (e.g. carriage 20*b* and/or storage bin 20*a*), rail 30, and/or through opening 22. The receptacle 22*a* of the lateral side 21*c* and/or carriage 20*b*, as shown in the one embodiment, may intersect the one or more through openings 22 and/or be adjacent the rail 30. The receptacle 22*a* may have an outwardly facing opening in the outer periphery 20*c* and/or lateral sides 21*c*.

In various embodiments, the adjustable bin 20 may include one or more rails/guides 30. The one or more rails 30 may be a variety of lengths, orientations, and positions within the appliance 10 or door 12. For example, a pair of rails 30 may extend from adjacent a top 12*a* and a bottom 12*b* of the inside or liner of the door 12. In other embodiments not shown, the rails may extend for one or more portions of the height of the door or compartment. The embodiments of the adjustable bin may further include one or more end plates or members 35 (e.g. top and/or bottom plates). The rails 30 may be spaced outwardly from the door liner (e.g. by the end plates). The one or more end plates 35 may be adjacent to and/or extend from the top 12*a* and bottom 12*b* of the door 12. The one or more rails 30 may extend between the one or more end plates 35, if used. The ends of one or more rails 30 may be secured to the one or more end plates 35. Further, two rails 30 may be used for one or more adjustable bins 20 as shown in the one embodiment. However one rail and/or three or more rails may be used. Moreover, one rail may be used in common with two or more additional/parallel rails to create adjacent pairs of rails or separate/parallel tracks for bins. One or more adjustable bins may be used/shared between a variety/plurality of rail systems (e.g. pairs of rails, single rails, etc. or combinations thereof) to create a variety of patterns or spacing with the appliance. The rails may be elongated tubes as shown in the one embodiment. The tubes may be non-circular or elongated in cross-section in various embodiments. In the one embodiment shown, the rails/guides may be made of stainless steel or another material.

In some implementations, the adjustable bin 20 (e.g. carriage 20*b*) may include one or more bushings 23. The one or more bushings 23, if used, may slidably engage or contact one or more rails 30. As shown in the one embodiment, two bushings 23 may be used on a single rail 30. Alternatively, a single bushing 23 may contact the rail. The adjustable bin 20 may include an upper bushing 23*a* adjacent the top side 21*a* of the adjustable bin 20 or top end 22*b* of the though opening 22. Moreover, in some embodiments, the adjustable bin may include a lower bushing 23*b* adjacent the bottom side 21*b* of the adjustable bin or bottom end 22*c* of the through opening 22. The upper and lower bushings 23*a*, 23*b* may be received in a receptacle adjacent the through opening 22 in the top and bottom sides 21*a*, 21*b*, respectively. The one or more actuators 40 may be positioned in releasable engagement with the rail 30 between the upper and lower bushings 23*a*, 23*b*. The bushing 23 may be positioned in the body 21 or carriage 20*b* within the through opening 22 and engages the outer periphery of the rail 30. The bushing 23 may position the adjustable bin 20, body 21, or carriage 20*b* away from the rail 30. The bushing 23 may be made of Acetyl or other material with high lubricity in some embodiments. The one or more bushings 23 carried by the body/carriage may be the only or reduced point of sliding contact between the rail and the remainder of the adjustable bin or portions thereof (e.g. body 21, carriage 20*b*, storage bin 20*a*, etc.). This may reduce binding when moving the adjustable bin 20 between different elevations or positions/locations (e.g. first location, second location different from the first location, etc.) along the length of the one or more rails 30. The bushing 23 may be arcuate in shape and surround the entire or portions of the outer periphery of the rail 30 in some embodiments. Although the bushing 23 is shown to surround the rail (e.g. 365 degrees) in the one embodiment, the one or more bushings may not make continuous contact or surround the rail in one or more horizontal planes. For example, the bushing may contact one or more portions of the rail less than 360 degrees about its circumference (e.g. 270 degrees, 90 degrees, two 90 degree portions spaced from each other equidistantly about the rail, etc.). The one or more bushings 40 may include one or more flanges. As shown in the one embodiment, at least one flange may be positioned extending outwardly from one end of the bushing.

In various embodiments, the adjustable bin 20 may include one or more actuators 40. The actuator 40 may be positionable between an engaged position (FIG. 2) to secure the adjustable bin 20 into at least one position/location or height/elevation relative to the rail 30 and a disengaged position (FIG. 3) to allow movement or travel along the rail 30 between two or more locations. In the one embodiment shown, the actuator 40 releasably engages (FIG. 2) and/or disengages (FIG. 3) from the rail 30. One or more biasing members 50, if used, may urge the actuator 40 towards the engaged position. The one or more biasing members 50 and the one or more actuators 40 may be positioned in the adjustable bin 20 or carriage 20*b* (e.g. lateral receptacle 22*a* and/or outer periphery 20*c* of the adjustable bin/carriage). The actuators 40 may engage the rail 30 between the top side 21*a* and the bottom side 21*b* of the body or carriage. On the other hand, stated alternatively, the actuator 40 may be positioned between the bushings 23*a*, 23*b*. The actuator 40 may be positioned in the outer periphery 20*c*, bottom side 21*b*, and/or one or more lateral sides 21*c* of the bin or carriage. The user may releasably engage and/or disengage the actuator 40 from the rail 30 to adjust the adjustable bin/carriage relative to the length of the rail between elevations/locations. In the one embodiment shown, the biasing member 50 may be one or more compression springs positioned within the receptacle 22*a* or portion thereof (e.g. pocket, portion of the receptacle, or cavity). The one or more actuators 40 may be positioned adjacent the one or more through openings 22 (e.g. within the receptacle) and/or engage the one or more rails 30. Although it is shown in the one embodiment that a pair of actuators 40 engages each one of the rails 30, respectively, it should be understood that the single trigger or actuator could be used.

Figure 3:
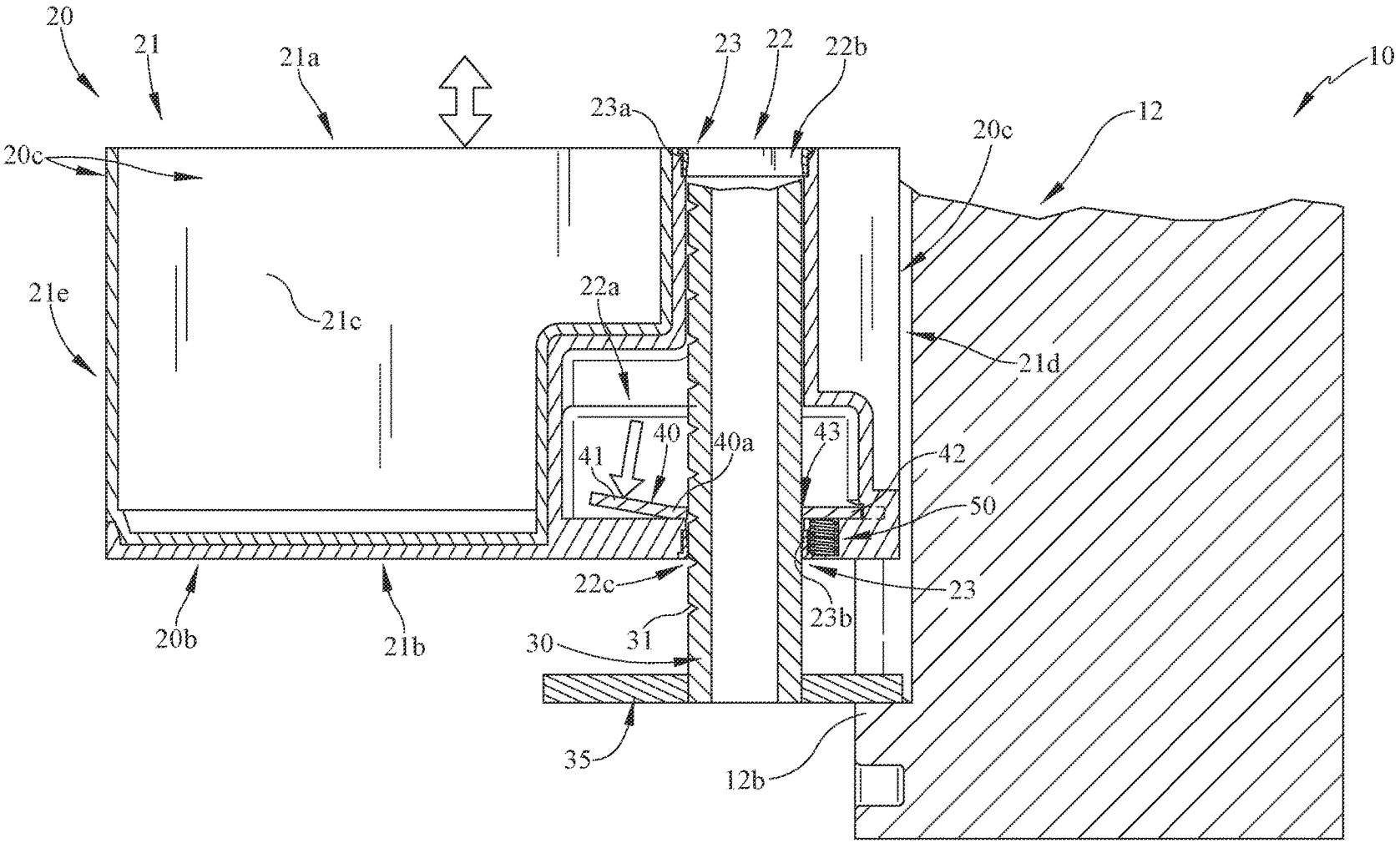
FIG. 3 is a sectional view of the embodiment of the adjustable bin of FIG. 1 taken along line 2-2 in a disengaged configuration, illustrating the actuator in a disengaged position with the rail and portions of the refrigerator door broken away.
Figure 4:
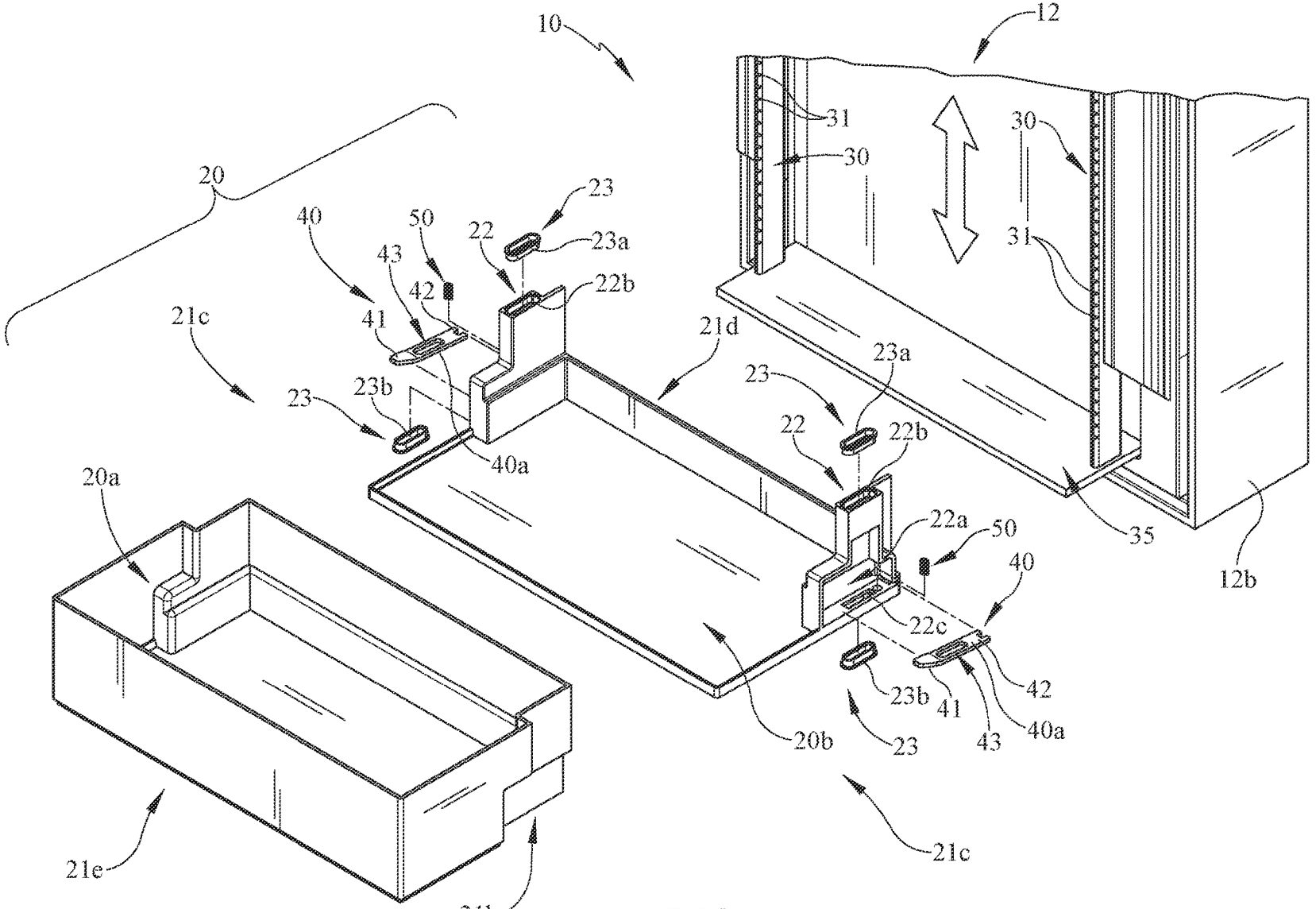
FIG. 4 is an exploded view of the adjustable bin of FIG. 1 removed from the refrigerator door.
Figure 5:
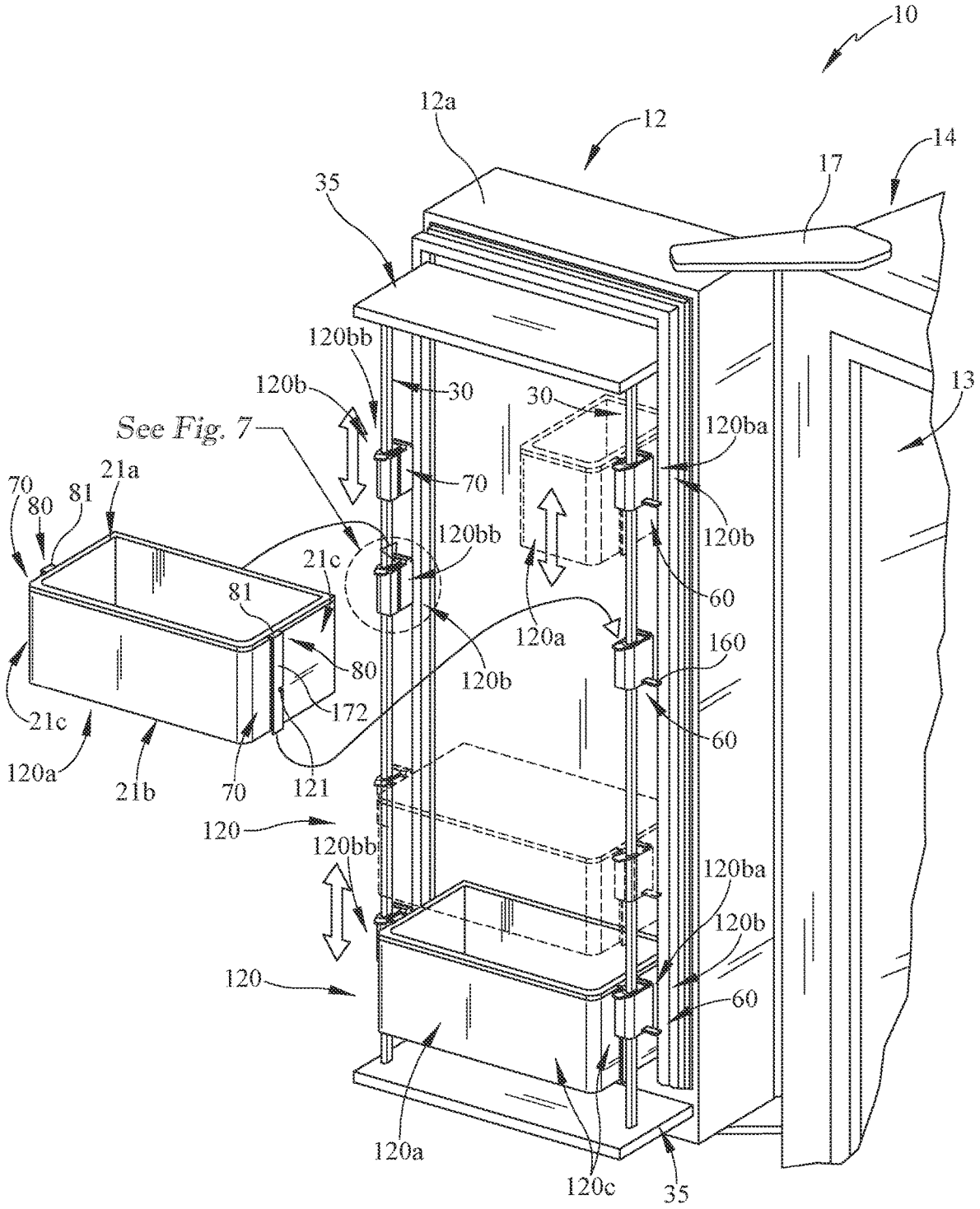
FIG. 5 is a perspective view of an embodiment of a refrigerator utilizing one or more adjustable bins within at least one door, with portions of the refrigerator broken away illustrating a removable storage bin separated from one or more carriages as well as one adjustable bin in broken lines moved to another position.
Figure 6:
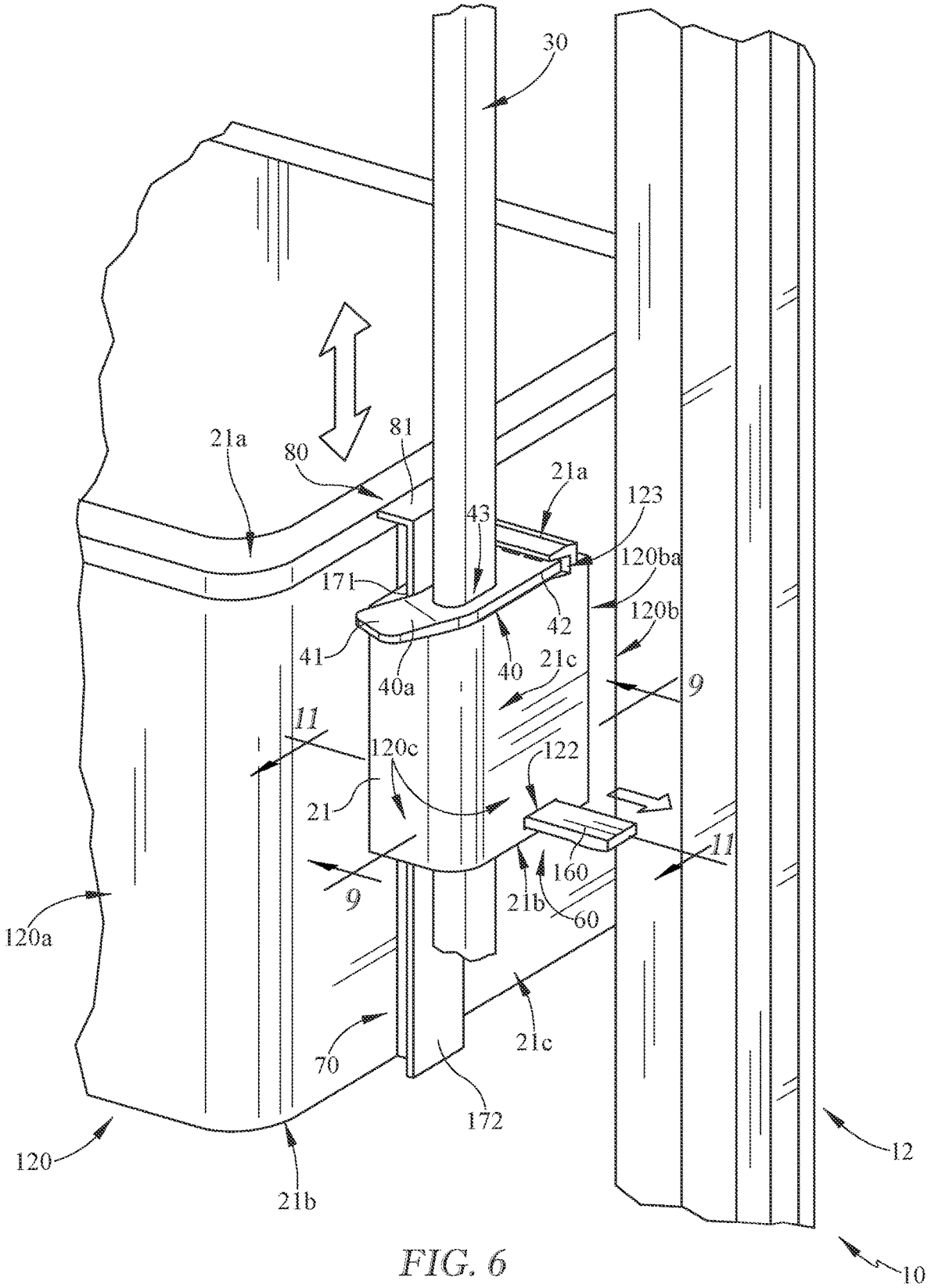
FIG. 6 is an enlarged perspective view of the adjustable bin of FIG. 5 illustrating the storage bin in an unfixed position being engaged with the carriage as well as the locking mechanism being in a disengaged or unlocked position.
Figure 7:
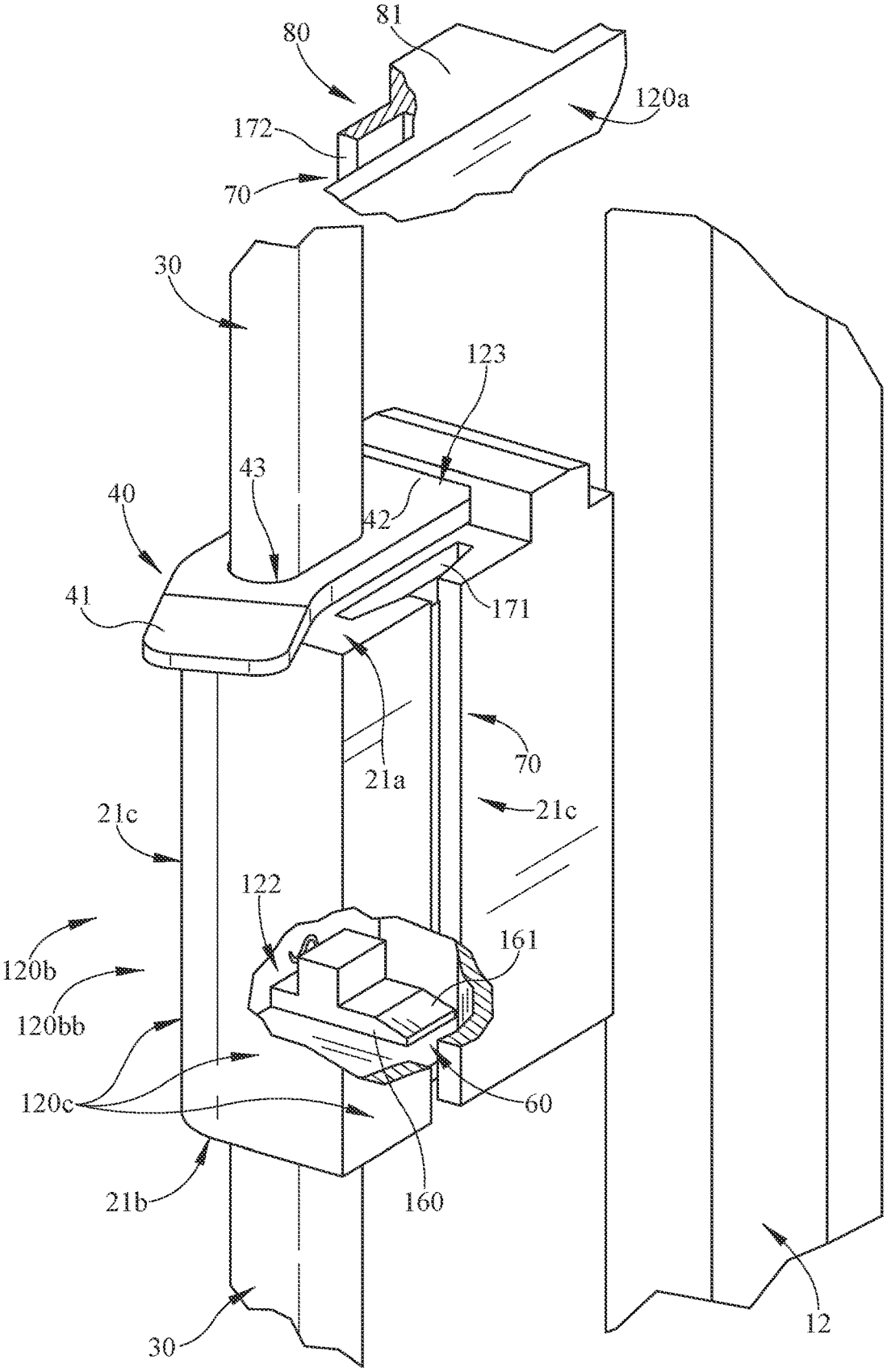
FIG. 7 is an enlarged perspective view of the carriage of FIG. 5 illustrating the storage bin removed therefrom.
Figure 8:
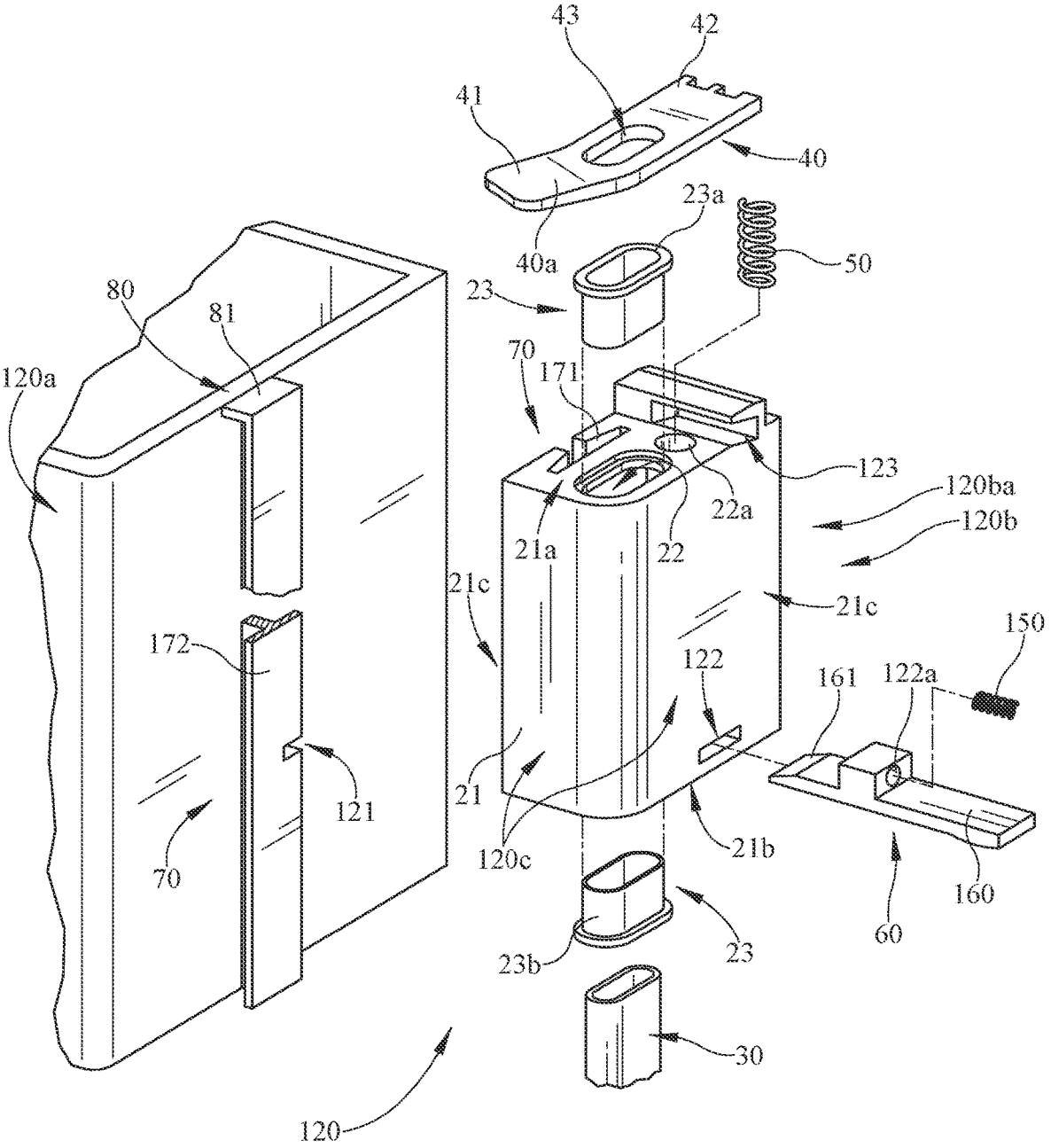
FIG. 8 is an exploded view of the adjustable bin of FIG. 5.

In some implementations, the one or more actuators 40 may be one or more members/plates 40*a* releasably engaging/disengaging from at least one rail 30. The member may include a pivoting or free end 41 and an opposing fixed end 42. The member 40*a*, pivoting end 41, or portions thereof pivots about the fixed end 42 to engage/disengage (e.g. lock and/or unlock) from the rail 30 to adjust the height of the adjustable bins 20. The fixed end 42 of the member 40*a* may be attached to the body 21 and/or carriage 20*b*. The pivoting end 41 or member 40*a* may pivot upwardly to a first pivot position (FIG. 2) to engage the rail 30 and fix the position of the adjustable bin 20 relative to the rail. When the user depresses the pivoting end 41 or member 40*a*, the member/pivoting end pivots downwardly from the engaged position to another or second pivot position (FIG. 3). In the second pivot position, the pivoting end 41 or member 40*a* may be disengaged from the rail 30 and may allow the adjustable bin 20 to travel/slide. The member 40*a* and/or actuator 40 may include a through opening 43 allowing the adjustable bin, bushing, or carriage to pass or slide the rail therethrough when in the disengaged position with the rail. The through opening 43, if used, may be positioned between the pivoting end 41 and the fixed end 42. When in the second pivot position or disengaged position (FIG. 3), the through opening 43 and member 40*a* becomes substantially perpendicular to the through opening 22 and/or rail 30. However, when the member 40*a* or actuator 40 is in the first pivot position or engaged position (FIG. 2) with the rail 30, the through opening 43 (e.g. the outer periphery defining the through opening) of the member 40*a* or actuator 40 may rest, bind, or contact (e.g. at an angle or position other than in the disengaged position) against the rail. This engagement provides binding to hold the position of the adjustable bin 20, bushing 23, or carriage 20*b* relative to the one or more rails 30 until subsequently actuated or depressed by the user. The biasing member 50, if used, may urge the member 40*a* or actuator 40 into the engaged position or upwardly into the first pivot position to create the binding. In some embodiments, the pivoting end 41 is the trigger or button the user may make contact with to engage/disengage the actuator 40. The plurality of notches 31, if used, spaced along the length or outer periphery of the rail or portions thereof may be engaged by the periphery of the through opening 43 of the actuator when in the engaged position.

It should be understood that the rails, bushings, actuators, body, plate members, etc. may be a variety of shapes, sizes, quantities, and constructions and still allow the adjustable bin or portions thereof to adjust between a plurality of positions. For example, the rail (e.g. outer periphery), bushing (e.g. through opening), body (e.g. through opening), and/or actuator (e.g. through opening) are shown in the one embodiment as elongated in cross section (e.g. oval, racetrack, arcuate, and/or oblong in shape) transverse to the longitudinal direction of the rail, however the structure may be a variety of shapes/sizes and still allow for releasable engagement and adjustability of the one or more adjustable bins.

In use to raise/lower an adjustable bin 20, the user may squeeze or depress each of the actuators 40 on the opposing lateral sides 21*c* while forcing the adjustable bin 20 on both sides to a higher/lower elevation. Once the adjustable bin is in the desired elevation/location, the user may release both of the actuators/triggers 40 to reengage or lock with the rails 30.

Figure 11:
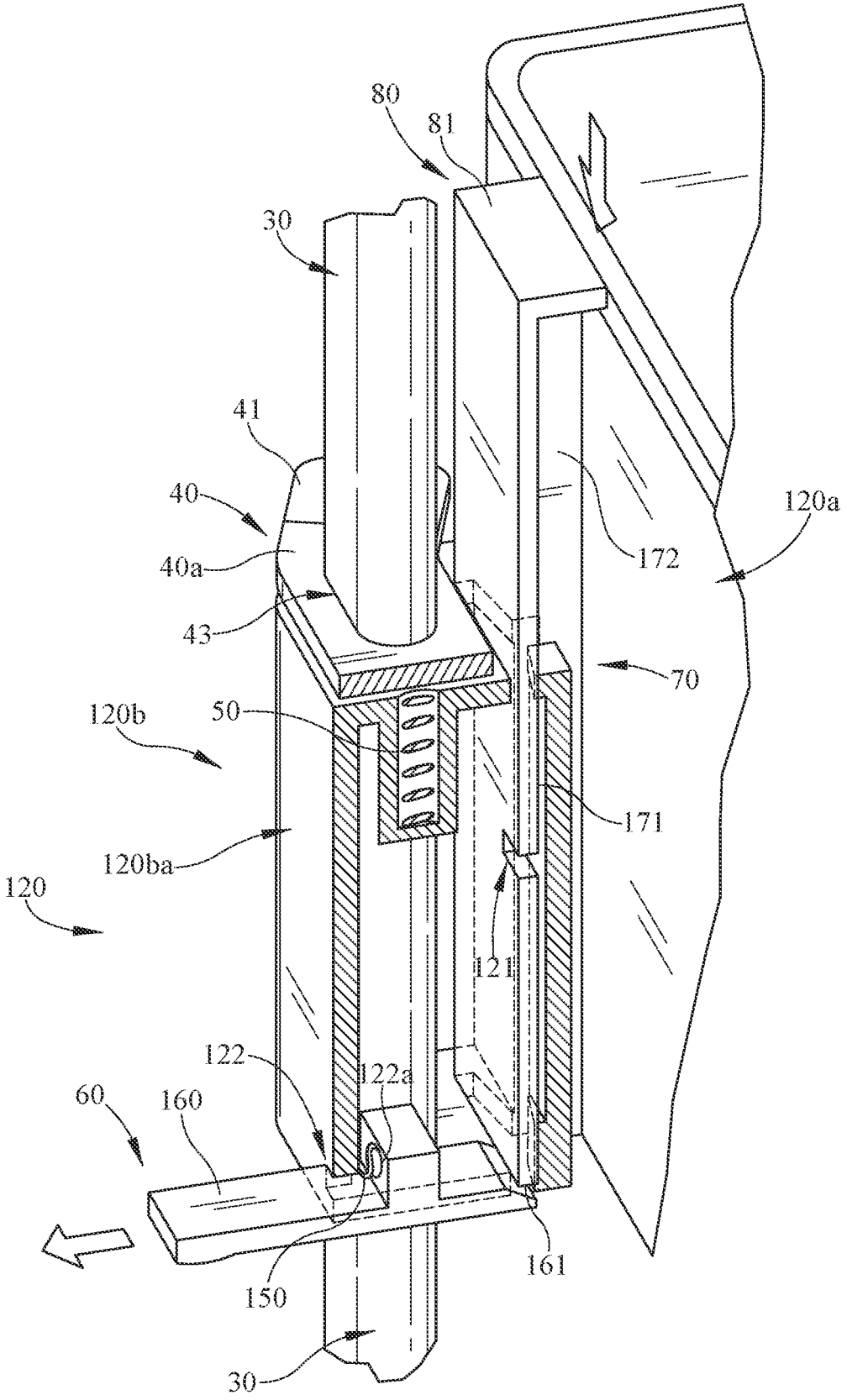
FIG. 11 is a sectional view of the embodiment of the adjustable bin of FIG. 6 taken along line 11-11, illustrating the locking mechanism in a disengaged position and the storage bin in an unfixed position when assembling the storage bin with the one or more carriages, and further illustrating the adjustable bin or portions thereof biasing the actuator of the locking mechanism away from the adjustable bin.
Figure 12:
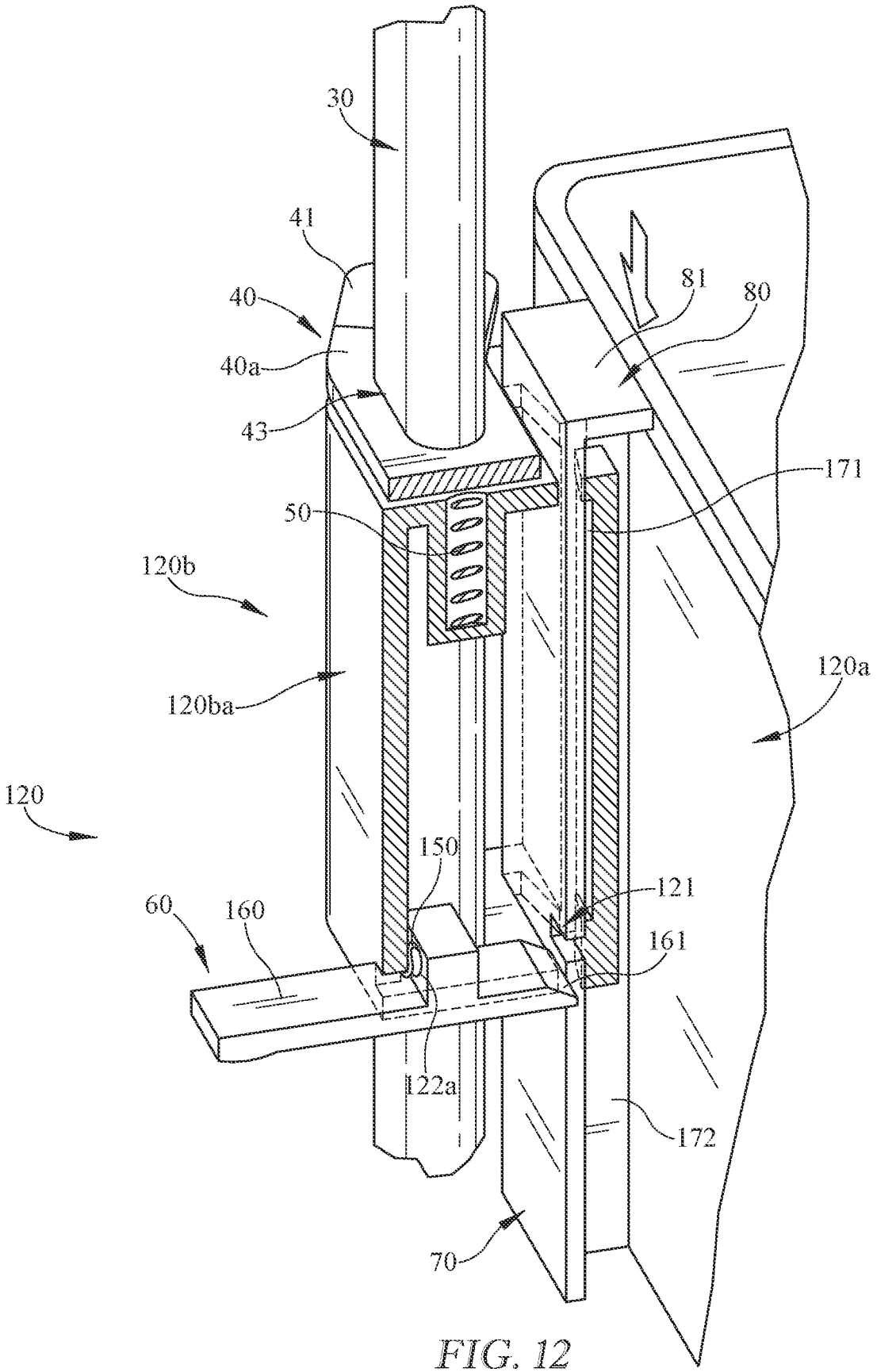
FIG. 12 is a sectional view of the embodiment of the adjustable bin of FIG. 11, further assembling the storage bin with the one or more carriages illustrating the locking mechanism in the disengaged position and the storage bin in the unfixed position, and further illustrating the actuator of the locking mechanism moving progressively towards an engaged or locked position with the storage bin.
Figure 13:
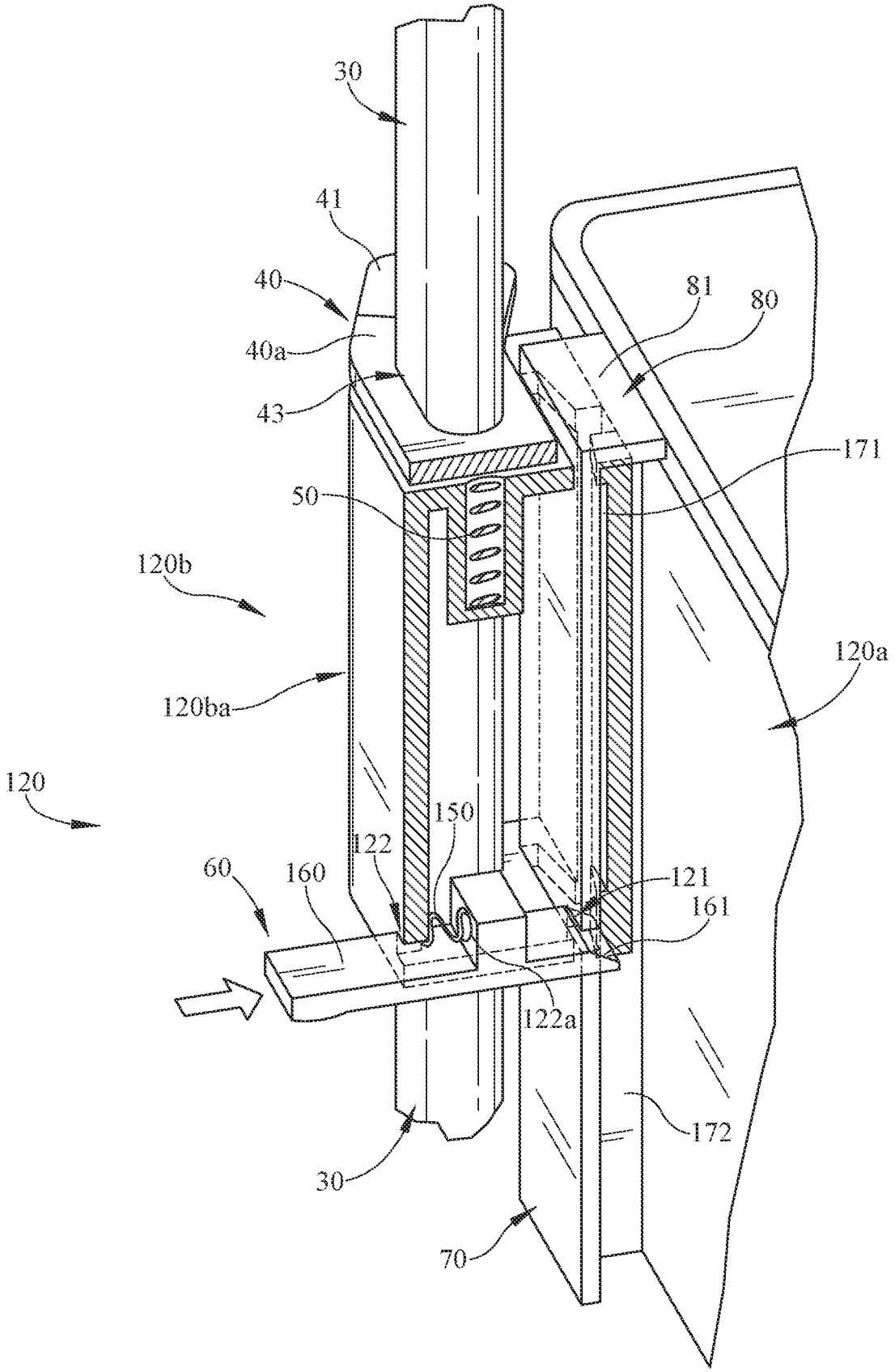
FIG. 13 is a sectional view of the embodiment of the adjustable bin of FIG. 11, illustrating the locking mechanism in the engaged position and the storage bin in a fixed position with the one or more carriages, and further illustrating biasing the actuator of the locking mechanism towards the adjustable bin.

Another embodiment of an adjustable bin 120 is shown in FIGS. 5-13. In some implementations, the adjustable bin 120 (e.g. carriage(s) 120*b*, storage bin(s) 120*a*, etc.) and/or appliance 10 may include one or more locking mechanisms 60. The locking mechanism 60 may releasably engage at least one storage bin 120*a* with the one or more carriages 120*b* (e.g. first 120*ba*, second 120*bb*). The locking mechanism 60, if used, may be one or more actuators 160 (e.g. second actuator) releasably engaging and/or disengaging one or more storage bins 120*a* and one or more carriages 120*b*. The actuator 160 may be positionable between an engaged position (FIGS. 9, 10, and 13) to secure the storage bin 120*a* into at least one position/location (e.g. fixed position) or height/elevation relative to the carriage 120*b* and a disengaged position (FIGS. 6, 11, and 12) to allow movement or travel of the storage bin 120*a* relative to the one or more carriages 120*b* to an unfixed position different from the fixed position. In the one embodiment shown in FIGS. 5-13, the carriage 120*b* (e.g. first 120*ba* and/or second 120*bb*) may include the actuator 160. Alternatively, or in addition thereto, the storage bin 120*a* may include the one or more actuators 160. One or more biasing members 150, if used, may urge or bias the actuator 160 towards the engaged position (e.g. storage bin 120*a*, receiving slot 121). The one or more biasing members 150 and/or the one or more actuators 160 may be positioned in the adjustable bin 120 and/or carriage 120*b* (e.g. guide opening 122 and/or outer periphery 120*c* of the adjustable bin/carriage). The biasing member 150 is shown in the one embodiment within the one or more carriages 120*ba*, 120*bb*. In the one embodiment shown, the biasing member 150 may be one or more compression springs positioned within a receptacle 122*a* or portion thereof (e.g. pocket, portion of the receptacle, or cavity). The actuator 160 may be a bias sliding member and/or plate sliding between the engaged position with the storage bin 120*a* and the disengaged position, different from the engaged position. The actuator 160 or bias sliding member may slide to releasably engage and/or disengage the storage bin 120*a* or portion thereof (e.g. receiving slot 121) from the one or more carriages 120*ba*, 120*bb*. The actuator 160 or bias sliding member may be in a sliding engagement with the through opening or guide opening 122 in the body 21 of the carriage 120*ba*, 120*bb*. The guide opening 122 may be perpendicular to the rails and/or through opening 22. The bias sliding member 160 may slide perpendicular to the rails 30 and/or through opening 22. The guide opening 122 may extend between the lateral sides 21*c* (e.g. interior and exterior) of the one or more carriages 120*ba*, 120*bb*. The guide opening 122 and/or actuator 160 may intersect the groove 171. The actuator 160 may slide between at least one first sliding position and at least one second sliding position different from at least one first sliding position. One example of the first sliding position may be the engaged position as shown in FIG. 13. One example of the second sliding position may be the disengaged position as shown in FIGS. 11 and 12. The actuator 160 may slide and/or be biased towards the engaged position, groove 171, or storage bin 120*a* to engage the storage bin 120*a* or portions thereof (e.g. receiving slot 121, tongue 172). In the engaged position, the storage bin 120*a* is fixed to one or more carriages 120*ba*, 120*bb*. When in the engaged position, the actuator 160 may engage a receptacle or receiving slot 121 and/or tongue 172 or other portion of the adjustable bin 120*a*. In the disengaged position, the storage bin 120*a* may be separated or moved away (e.g. vertically, horizontally, etc.) from the one or more carriages 120*ba*, 120*bb* or engaged position. In the disengaged positioned, the storage bin 120*a* is unfixed to the one or more carriages 120*ba*, 120*bb*. In the unfixed position, the storage bin may be engaged to the one or more carriages by one or more attachments (e.g. tongue and groove engagement). The user may slide the actuator 160 out of the receiving slot 121 or away from the engaged position to allow relative movement of the storage bin away from the one or more carriages 120*ba*, 120*bb*. When the storage bin 120*a* is disengaged/unfixed (e.g. vertically) or separated from the one or more carriages 120*ba*, 120*bb*, the storage bin 120*a* may be cleaned and/or moved to another position or one or more carriages 120*b*. The actuating member 160 may include a cam or sloped surface 161 to displace the actuating member into a biased positioned or disengaged position away from an unbiased/engaged position when assembling or coming into engagement with the storage bin 120*a* or portions thereof (e.g. tongue) as shown in FIG. 11. The cam 161 may be at one end (e.g. distal end, upper surface) of the elongated member 160. The biased sliding member or actuator 160 may then return or slide towards (e.g. biased in a direction) the storage bin 120*a* to the engaged position or unbiased position with the storage bin or portion thereof (e.g. receiving slot) as shown in FIG. 13. The actuating member 160 may subsequently engage the storage bin 120*a* or portion thereof (e.g. receiving slot 121) when aligned, in the fully engaged or fixed position, and/or when the stop mechanism 80 is engaged between the storage bin and one or more carriages.

In some implementations, the adjustable bin 120, one or more storage bins 120*a*, one or more carriages 120*b*, and/or appliance 10 may include one or more attachments 70 between the one or more storage bins 120*a* and the one or more carriages 120*ba*, 120*bb*. As shown in the one embodiment in FIGS. 5-13, the attachment 70 may be one or more tongue and groove engagements 170 between the storage bin 120*a* and the one or more carriages 120*ba*, 120*bb*. The one or more carriages 120*ba*, 120*bb* may include one or more grooves 171 (e.g. vertically orientated, one or more T-shaped slots) extending from the top side 21*a* of the body 21 through the bottom side 21*b* of the body 21. The storage bin 120*a* may include the one or more projections or tongues 172 (e.g. one or more T-shaped posts, vertically orientated) projecting from one or more lateral sides 21*c* of the storage bin. The one or more T-shaped posts and/or tongues may extend for a length along the exterior and/or lateral sides 21*c* of the body or outer periphery 120*c* of the storage bin 120*a*. Alternatively, the carriage may include the tongue and the storage bin may include the groove. The tongue 172 slidably engages the groove 171 when assembling/disassembling (e.g. engaging, disengaging) the storage bin with the one or more carriages. The receiving slot 121, if used, may be positioned within the tongue as shown in the one embodiment or in other portions of the storage bin. The tongue and groove engagement or portions thereof may be a variety of shapes, sizes, quantities, and construction and still be within the scope of the invention.

In some implementations, the adjustable bin 120, one or more storage bins 120*a*, one or more carriages 120*b*, attachment 70, and/or appliance 10 may include one or more stop mechanisms 80 between the one or more storage bins 120*a* and the one or more carriages 120*ab*, 120*bb*. The stop mechanism 80, if used, may limit the relative movement (e.g. vertical, travel) between the storage bin 120*a* and the one or more carriages 120*b*. The stop mechanism 80 may stop the travel or movement of the storage bin 120*a* relative to the one or more carriages 120*ba*, 120*bb* when in the fully engaged position or fixed. The travel (e.g. along the tongue and groove engagement 170, if used, or sliding direction (e.g. vertical direction)) may be limited when the stop mechanism 80 engages. The stop mechanism 80 may include an engaged position (e.g. FIG. 13) wherein the relative travel is prevented or stopped and a disengaged position (e.g. FIGS. 11 and 12) different from the engaged position. When in the engaged position, the stop mechanism 80 may be one or more projections or members 81 interfering with or stopping the relative movement between the one or more carriages 120*b* and the one or more storage bins

120*a*. In the one embodiment shown in FIGS. 5-13, one or more members 81 project from the one or more storage bins 120*a* (e.g. one or more lateral sides, outer periphery) to prevent or stop downward travel of the storage bin 120*a* relative to the one or more carriages 120*b*. When the stop mechanism 80 or member 81 of the storage bin abuts or engages the one or more carriages 120*b*, or portions thereof, in the engaged position the storage bin may be stopped or prevented from further downward travel when in the tongue and groove engagement therebetween. When stopped by the stop mechanism 80, the storage bin may be in the fixed position (e.g. in the fully engaged and/or at a bottom/fixed position) with the carriage and/or the locking mechanism 60 (e.g. actuator 160) may be in the engaged and/or locked position (e.g. engaging the storage bin or receiving slot). Alternatively, in some embodiments, the member of the stop mechanism may project from the one or more carriages and engage a portion of the storage bin to prevent or stop relative movement therebetween. Further as shown in the one embodiment in FIGS. 5-13, the tongue and groove engagement 170 may include the member 81 or stop mechanism 80. As shown, the member or plate 81 may project from the tongue 172 (e.g. upper end) of the storage bin (e.g. lateral side 21*c*), or portion thereof. When the tongue and groove engagement 170, if used, allows engaging/sliding in the vertical direction (e.g. downward travel of the storage bin 120*a*), the member 81 projecting from the tongue 172 may engage/abut a portion of the one or more carriages 120*b* (e.g. top side 21*a*) and stops the relative movement therebetween.

One or more carriages 120*ba*, 120*bb* may be used to move along one or more rails 30 between at least one first location or position and at least one second location different from the first location. The plurality of carriages 120*b* may move along the rails 30 independently of each other in some embodiments as more clearly shown in FIG. 1. For example, when the storage bin 120*a* is in the unfixed position or separated from plurality of carriages 120*b* (e.g. first and second carriages 120*ba*, 120*bb*) the carriages may be independently positioned between one or more locations (e.g. same elevation, different elevation, offset, horizontal). Two or more carriages 120*b* may move together along the one or more rails 30 when engaging one or more storage bins 120*a*. As shown in FIGS. 5-13, the first carriage 120*ba* may be movable along a first rail 30 and/or the second carriage 120*bb* may be movable along a second rail 30. The storage bin 120*a* may releasably engage one or more carriages 120*b*. Alternatively, the storage bin 120*a* may be fixed or of a unitary construction with one or more carriages. The storage bin 120*a* may releasably engage (e.g. one or more attachments 70) both the first carriage 120*ba* and the second carriage 120*bb*. The storage bin 120*a* may releasably engage a single carriage, alone or in combination with a fixed carriage. The tongue and groove engagement 170, if used, may be used between one or more storage bins 120*a* and the one or more carriages 120*b* (e.g. first carriage and/or second carriage). One or more carriages 120*b* (e.g. first carriage and/or second carriage) and/or one or more storage bins 120*a* may include the stop mechanism 80, if used, to limit relative travel therebetween. The one or more carriages 120*b* (e.g. first carriage and/or second carriage) may include the locking mechanism 60 (e.g. actuator 160) releasably securing the storage bin 120*a* to the one or more carriages 120*b* between the fixed position and unfixed position. Although each carriage may include the same structure as shown (e.g. tongue and groove engagement 170, one or more actuators 40, stop mechanism 80, locking mechanism 60, attachments 70, etc.), the carriages may include different structure from each other. For example, although each carriage includes the locking mechanism 60, in some embodiments the first carriage may include the locking mechanism while the second carriage may not include the locking mechanism.

In some implementations, the one or more biasing members 50 and the one or more actuators 40 may be positioned in the adjustable bin 120 and/or one or more carriages 120*b* (e.g. outer periphery 120*c* of the adjustable bin/carriage). As shown in the one embodiment in FIGS. 5-13, the actuators 40 may engage the rail 30 above the top side 21*a* of the body or carriage. On the other hand, stated alternatively, the actuator 40 may be positioned above the bushings 23*a*, 23*b*. The actuator 40 may be positioned in the outer periphery 120*c* and/or top side 21*a* of the one or more carriages 120*b*. The user may releasably engage and/or disengage the actuator 40 from the rail 30 to adjust the adjustable bin(s)/carriage (s) relative to the length of the one or more rails between elevations/locations. In the one embodiment shown, the biasing member 50 may be one or more compression springs positioned within the receptacle 22*a* or portion thereof (e.g. pocket, portion of the receptacle, or cavity). The one or more actuators 40 may be positioned adjacent the one or more through openings 22 (e.g. within the top side, or outer periphery) and/or engage the one or more rails 30. Although it is shown in the one embodiment that a pair of actuators 40 engages each one of the rails 30, respectively, it should be understood that the single trigger or actuator could be used.

Figure 9:
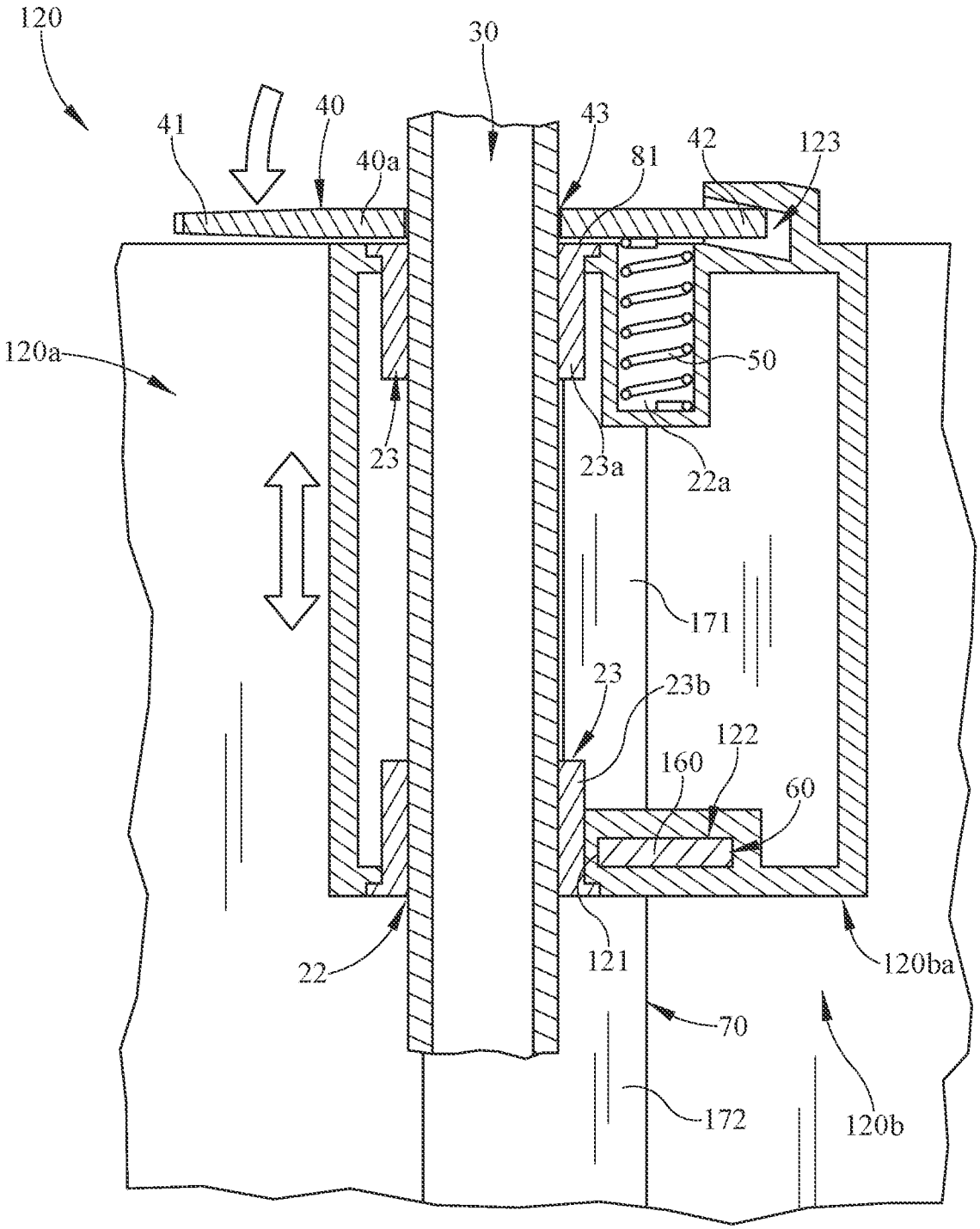
FIG. 9 is a sectional view of the embodiment of the adjustable bin of FIG. 6 taken along line 6-6 in a disengaged configuration, illustrating the actuator in a disengaged position with the rail, the locking mechanism engaged, and the stop mechanism engaged.
Figure 10:
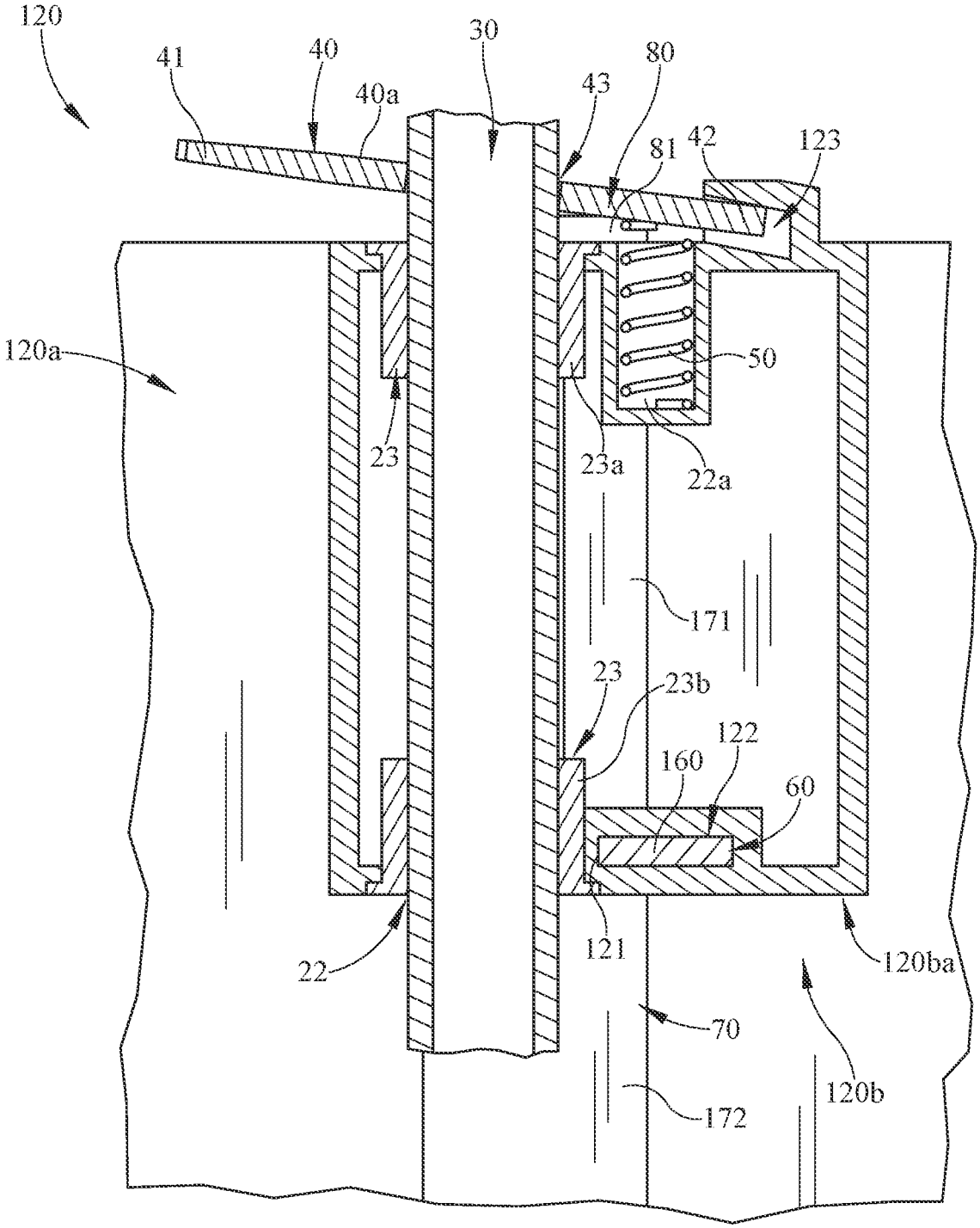
FIG. 10 is a sectional view of the embodiment of the adjustable bin of FIG. 6 taken along line 6-6 in an engaged configuration, illustrating an actuator in an engaged position with a rail, the locking mechanism engaged, and the stop mechanism engaged.

In some implementations, the one or more actuators 40 may be one or more members/plates 40*a* releasably engaging/disengaging from at least one rail 30. The member may include a pivoting or free end 41 and an opposing fixed end 42. The member 40*a*, pivoting end 41, or portions thereof pivots about the fixed end 42 to engage/disengage (e.g. lock and/or unlock) from the rail 30 to adjust the height of the adjustable bins 120 and/or carriage 120*b*. The fixed end 42 of the member 40*a* may be attached to the body 21 and/or carriage 120*b*. As shown in FIGS. 5-13, the fixed end 42 is positioned within one or more slots 123 (e.g. horizontal slot, an open ended slot). The slot 123 may face the rail 30 and/or bushing 23. The slot may be positioned in the top side 21*a*. The pivoting end 41 or member 40*a* may pivot upwardly to a first pivot position (FIG. 10) to engage the rail 30 and fix the position of the adjustable bin 120 and/or carriage(s) 120*b* relative to the rail. When the user depresses the pivoting end 41 or member 40*a*, the member/pivoting end pivots downwardly from the engaged position to another or second pivot position (FIG. 9). In the second pivot position, the pivoting end 41 or member 40*a* may be disengaged from the rail 30 and may allow the adjustable bin 120 and/or carriage 120*b* to travel/slide. The member 40*a* and/or actuator 40 may include a through opening 43 allowing the adjustable bin, bushing, and/or carriage to pass or slide the rail therethrough when in the disengaged position with the rail. The through opening 43, if used, may be positioned between the pivoting end 41 and the fixed end 42. When in the second pivot position or disengaged position (FIG. 9), the through opening 43 and member 40*a* becomes substantially perpendicular to the through opening 22 and/or rail 30. However, when the member 40*a* or actuator 40 is in the first pivot position or engaged position (FIG. 10) with the rail 30, the through opening 43 (e.g. the outer periphery defining the through opening) of the member 40*a* or actuator 40 may rest, bind, or contact (e.g. at an angle or position other than in the disengaged position) against the rail. This engagement provides binding to hold the position of the adjustable bin 120, bushing 23, and/or carriage 120*b* relative to the one or more rails 30 until subsequently actuated or depressed by the user.

The biasing member 50, if used, may urge the member 40*a* or actuator 40 into the engaged position or upwardly into the first pivot position to create the binding. In some embodiments, the pivoting end 41 is the trigger or button the user may make contact with to engage/disengage the actuator 40. Although the notches are not shown in FIGS. 5-13, if used, the plurality of notches may be spaced along the length or outer periphery of the rail or portions thereof may be engaged by the periphery of the through opening 43 of the actuator when in the engaged position.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A refrigerator appliance comprising:

a first rail;

a first carriage moveable along the first rail between at least one first location and at least one second location, wherein the at least one first location is different from the at least one second location;

a storage bin;

a locking mechanism releasably engaging the storage bin with the first carriage;

wherein the first carriage includes:

at least one through opening having an outer periphery defined by the first carriage, and wherein the at least one through opening slidably receives the first rail; and at least one first actuator positionable between an engaged position securing the first carriage to the first rail in the at least one first location and a disengaged position allowing the first carriage to move between the at least one first location and the at least one second location.

2. The refrigerator appliance of claim 1 wherein the locking mechanism includes a second actuator to releasably engage and/or disengage the storage bin from the first carriage.

3. The refrigerator appliance of claim 2 further comprising a biasing member urging the second actuator into engagement with the storage bin.

4. The refrigerator appliance of claim 2 wherein the first carriage includes the second actuator, and the second actuator slides to releasably engage and/or disengage the storage bin from the first carriage.

5. The refrigerator appliance of claim 1 further comprising a tongue and groove engagement between the storage bin and the first carriage.

6. The refrigerator appliance of claim 5 further comprising a stop mechanism, wherein the stop mechanism limits relative movement between the storage bin and the first carriage along the tongue and groove engagement between the storage bin and the first carriage.

7. The refrigerator appliance of claim 1 further comprising a second carriage movable along a second rail, wherein the storage bin releasably engages both the first carriage and the second carriage.

8. A refrigerator appliance comprising:

at least one first rail;

at least one first carriage moveable along the at least one first rail between at least one first location and at least one second location, wherein the at least one first location is different from the at least one second location;

at least one storage bin;

the at least one first carriage includes:

at least one through opening having an outer periphery defined by the at least one first carriage, and wherein the at least one through opening slidably receiving the at least one first rail;

at least one first actuator positionable between an engaged position securing the at least one storage bin to the at least one first carriage in a fixed position and a disengaged position allowing the at least one storage bin to move to an unfixed position different from the fixed position; and at least one second actuator positionable between an engaged position securing the at least one first carriage to the at least one first rail in the at least one first location and a disengaged position allowing the at least one first carriage to move between the at least one first location and the at least one second location.

9. The refrigerator appliance of claim 8 further comprising at least one bushing, wherein the at least one bushing is positioned within the at least one through opening positioning the at least one first carriage from contact with the at least one rail, wherein the at least one bushing is fixed to the outer periphery defining the at least one through opening and slidably contacting the at least one first rail.

10. The refrigerator appliance of claim 8 further comprising a tongue and groove engagement between the at least one storage bin and the at least one first carriage.

11. The refrigerator appliance of claim 10 further comprising a stop mechanism limiting travel of the at least one storage bin along the tongue and groove engagement.

12. The refrigerator appliance of claim 11 wherein the stop mechanism is a member projecting from the at least one storage bin to prevent downward travel of the at least one storage bin relative to the at least one first carriage when the tongue and groove engagement is engaged therebetween.

13. The refrigerator appliance of claim 10 wherein the at least one first actuator is a bias sliding member sliding to releasably engage and/or disengage a slot of the at least one storage bin.

14. The refrigerator appliance of claim 8 further comprising at least one second carriage movable along at least one second rail, wherein the at least one storage bin releasably engages both the at least one first carriage and the at least one second carriage.

15. A refrigerator appliance comprising:

one or more rails;

one or more carriages moveable along the one or more rails between at least one first location and at least one second location, wherein the at least one first location is different from the at least one second location;

one or more storage bins releasably engaging the one or more carriages; and one or more actuators positionable between an engaged position securing the one or more storage bins to the one or more carriages in a fixed position and a disengaged position allowing the one or more storage bins to move to an unfixed position different from the fixed position.

16. The refrigerator appliance of claim 15 wherein the one or more actuators is positionable between an engaged position securing the one or more carriages to the one or more rails in the at least one first location and a disengaged position allowing the one or more carriages to move between the at least one first location and the at least one second location.

17. The refrigerator appliance of claim 15 wherein the one or more carriages includes at least one through opening having an outer periphery defined by the one or more carriages, and wherein the at least one through opening slidably receiving the one or more rails; and at least one bushing positioned within the at least one through opening positioning the one or more carriages from contact with the one or more rails, wherein the at least one bushing is fixed to the outer periphery defining the at least one through opening and slidably contacting the one or more rails.

18. The refrigerator appliance of claim 15 wherein the one or more carriages includes at least one first carriage and at least one second carriage moving independently of the at least one first carriage.

19. The refrigerator appliance of claim 18 wherein the one or more storage bins releasably engaging both the at least one first carriage and the at least one second carriage with a tongue and groove engagement.

20. The refrigerator appliance of claim 15 wherein the one or more carriages includes the one or more actuators.

21. The refrigerator appliance of claim 15 wherein the one or more actuators slide between the engaged position and the disengaged position.

* * * * *